United States Patent [19]

Martin

[11] 4,082,271

[45] Apr. 4, 1978

[54] TENNIS PRACTICE AND TEACHING REBOUNDER

[76] Inventor: Arthur Lee Martin, 2876 N. Rogers Ave., Ellicott City, Md. 21043

[21] Appl. No.: 681,762

[22] Filed: Apr. 29, 1976

[51] Int. Cl.[2] ..... A63B 61/00

[52] U.S. Cl. ..... 273/29 A; 273/26 A

[58] Field of Search ..... 273/26 A, 29 R, 29 A, 273/181 R, 181 F, 181 I, 181 K, 181 J, 127 R, 127 B; 350/117, 120, 124, 126, 127; 211/180; 160/330, 237, 84, 351, 377, 349, 264

[56] References Cited

U.S. PATENT DOCUMENTS

| | | | |
|---|---|---|---|
| 1,733,214 | 10/1929 | Alexander et al. | 211/180 |
| 2,021,106 | 11/1935 | Johnson | 160/237 |
| 2,944,816 | 7/1960 | Dixon | 273/26 |
| 3,180,643 | 4/1965 | Kallai | 273/29 A |
| 3,205,772 | 9/1965 | Guske | 350/117 |
| 3,328,033 | 6/1967 | Hendry | 273/127 R X |
| 3,427,026 | 2/1969 | Mahoney | 273/1.5 A |
| 3,563,544 | 2/1971 | Hedrick | 273/29 A |
| 3,836,144 | 9/1974 | Mahoney | 273/1.5 A |
| 3,918,717 | 11/1975 | Zak | 273/29 A |

*Primary Examiner*—Richard C. Pinkham
*Assistant Examiner*—T. Brown
*Attorney, Agent, or Firm*—John F. McClellan, Sr.

[57] ABSTRACT

A tennis practice and teaching rebounder having a net wall for time delay in rebound, tension adjustment for controlling velocity of rebound, vertical angle adjustment for providing high or low bounce on return, and orientable for providing backhand or forehand return. Tube structural members define a rectangular base mounting fixed, angled, centered supports holding an upper standard along which the upper edge of the net wall resiliently attaches. A similarly attached lower standard draws down the lower edge of the net wall under tension determined by turnbuckle-and-chain connection with the ends of the base through fore-and-aft slip-and-lock closed channels affording the vertical-angle adjustment. Tension members at the ends of the standards stretch the net horizontally. A plastic apron affixed at regulation net height covers the base and wheels and skids support the base. Slip connectors and special brackets provide quick knock-down and set-up.

15 Claims, 7 Drawing Figures

TENNIS PRACTICE AND TEACHING REBOUNDER

This invention relates generally to tennis practice devices and specifically to a net-wall rebound structure.

In the prior art numerous tennis practice devices appear which employ nets, but it is believed that the present invention provides action, adjustment, quick set-up and knock-down features, and economy of design, not previously made available.

A principal object of the invention is to provide a quality tension-and-angle controlled net wall rebounder which provides for practice and training superior to that of any known rebounder, and better simulates conditions encountered in actual play.

Further objects are to provide a rebounder as described which can easily be adjusted within wide ranges with speed and precision, and which is light and can be moved easily from one location to another by anyone, but which maintains adjustment and position under hard, prolonged use.

Still further objects are to provide a rebounder as described which can be stored outdoors in all weather for indefinite periods, which can, using slip-fit tube and bolt attachments, be set-up and adjusted, and can be knocked down, in minutes, which comprises an easily portable bundle of elements when knocked down, and which employs the same base to support standards and nets of different widths.

And yet further objects are to provide a rebounder as described which permits intentionally warping the net but which makes net-warpage through damage almost impossible.

Still further objects are to provide a rebounder as described which is unobtrusive and functionally pleasing in appearance, which is economical to manufacture, ship, purchase and maintain, which is safe and easy to use, and which is flexibly adaptable to a variety of users.

In brief summary given for purposes of cursive exposition only, the invention includes a frame holding a rebound net wall between a pair of vertically spaced horizontal standards, the lower standard being adjustably movable relative to the upper standard.

The above and other objects and advantages of the invention will become more readily apparent on examination of the following description including the drawings in which like reference numerals refer to like parts:

Figure 1:
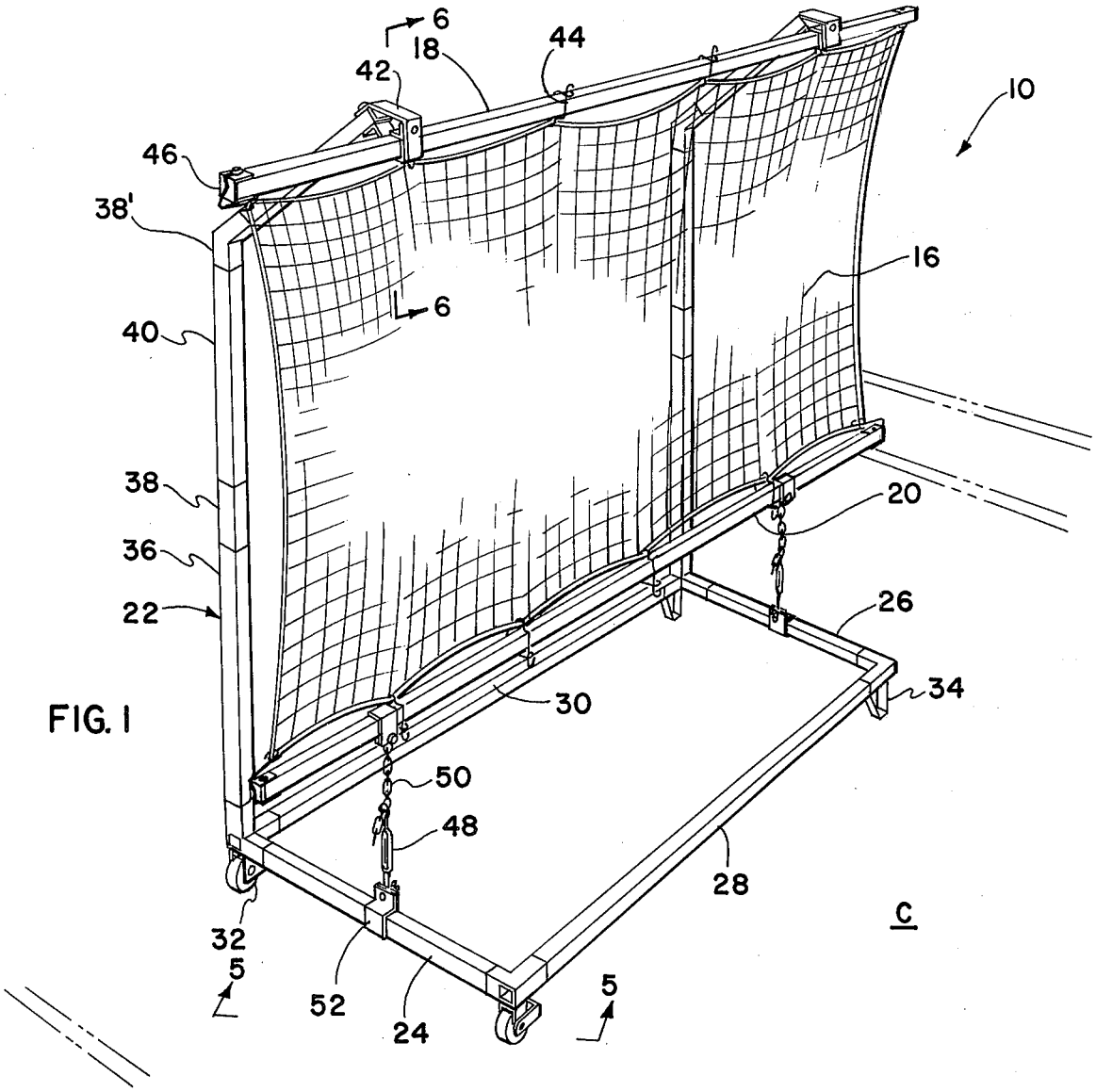
FIG. 1 is an isometric view.
Figure 6A:
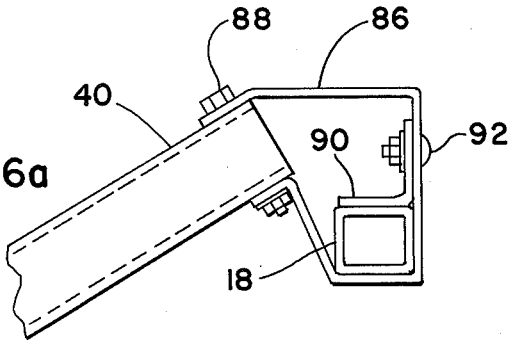
Figure 6B:
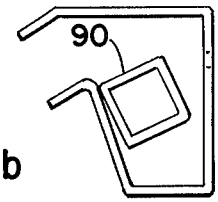

FIGS. 6*a* and 6*b* are elevational details taken at 6—6, FIG. 1.

FIG. 1 shows the invention 10 in position for use on a tennis court C. A frame supports net-wall 16 between first and second horizontal standards 18, 20 vertically spaced and adjustably related, as follows.

Base or lower frame 22, formed of tubing, comprises preferably an open rectangle in plan, with first and second fore and aft ends 24, 26 and front 28 and back 30. Wheels 32 at the corners support the first end and fixed stands 34 at the corners support the second end. Paired lower frame uprights 36 rise vertically from respective rear corners of the lower frame and terminate in respective slip-fit aluminum box connectors 38, intermediate the height of the net.

Upper frame members include a pair of davit arms 40 rising vertically from slip-fit support in the aluminum box connectors, and then angling inward at 45° or otherwise inclining to a plane perpendicular to and centered over the base. Angle box-connector 38' is advantageously provided at the angle juncture on each davit arm. Respective clips 42 secured to the davit arms support the upper standard, which in turn supports the upper edge of the net by means of resilient net-holders or spring retainers 44 looped around the standard and the margin of the net.

An end tension retainer 46 resiliently draws each corner of the net wall outward along the adjacent standard, holding the end wall taut horizontally. The lower net wall margin attaches to the lower standard in similar manner to the upper margin resilient attachment to the upper standard. At each end of the base, assembly including a turnbuckle 48 adjustably attached at one end to chain 50 provides means for adjustably drawing the lower standard toward the base and by means of position adjustment of respective slip-and-lock closed channels 52 employed for movable attachment at the ends of the base provides also for pivotal adjustment of the vertical angle of the net wall about the upper margin of the net wall as will be seen in more detail in a later Figure.

The combination of net-wall and support described provides a surprising improvement in practice and training advantage over solid structures in affording a just-right split-second delay in rebound.

Figure 2:
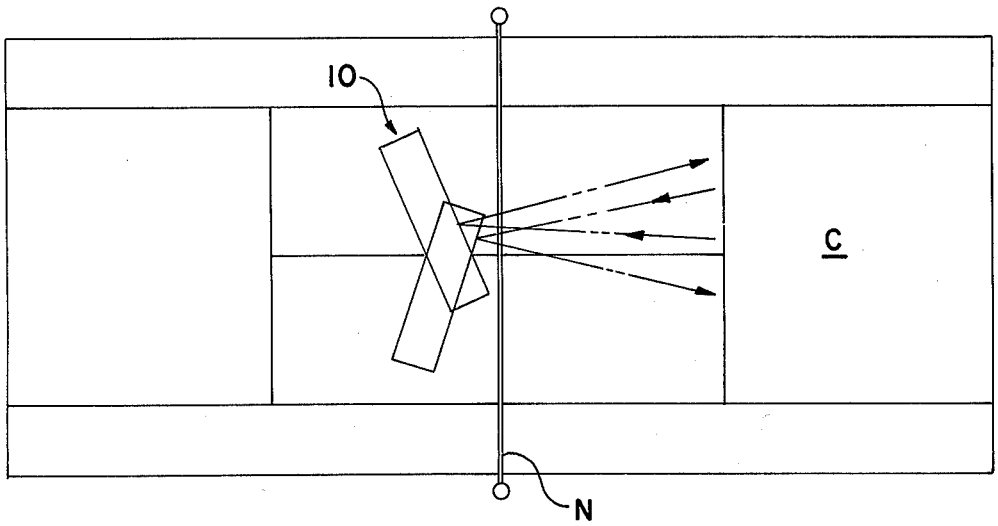
FIG. 2 is a plan view.

FIG. 2 indicates in plan view of the invention 10 in place on a tennis court C proximate a playing net N how the invention can be oriented to return balls to forehand or to backhand, as desired. Pivoting the invention is easily accomplished by lifting the second or standard-supported end of the base slightly and orienting the structure by moving it on the wheels.

Figure 3:
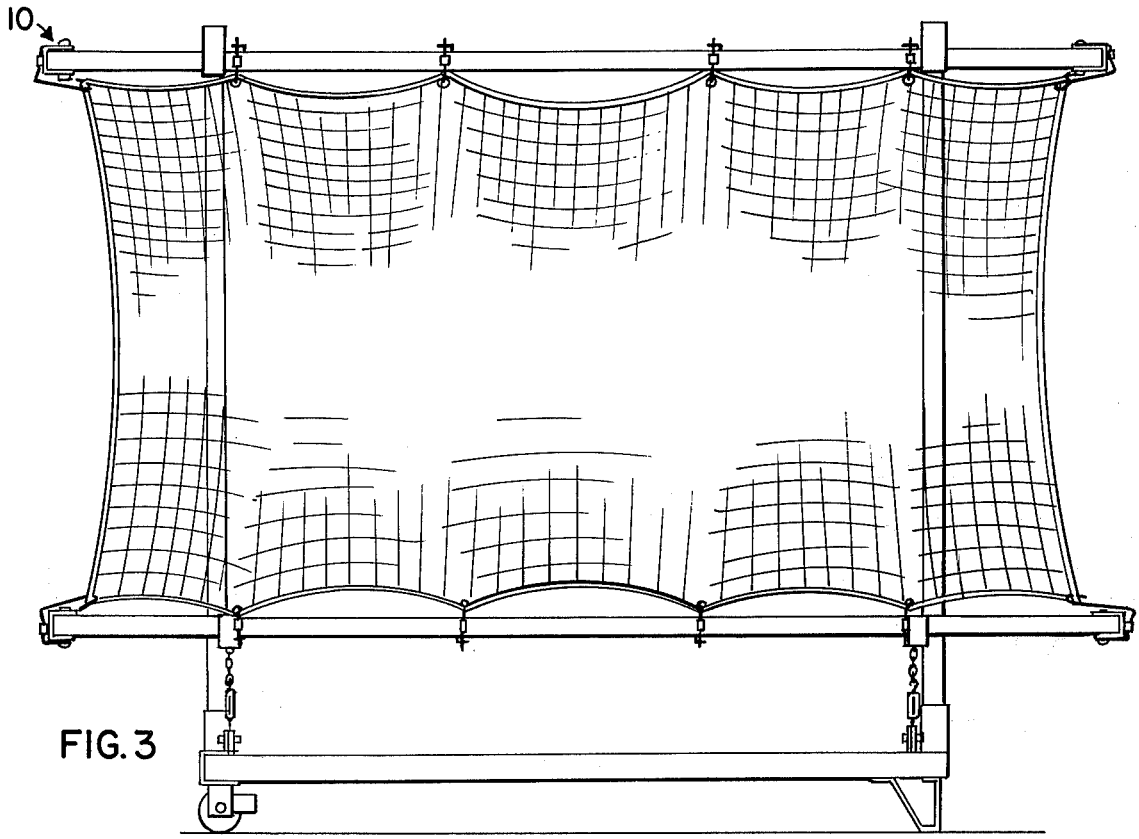
FIG. 3 is a front elevation.

FIG. 3 shows the invention 10 in front elevation. A convenient height for the unit is 9 feet (2.74 meters) providing a 6 foot (1.83 meters) target height over the standard playing net, but the unit may be made higher or lower if desired. The lower standard is lower than the top of a standard playing net.

Sixty to 90 square-foot versions with widths of from 10 feet (3.05 meters) to 16 feet (4.88 meters) have proved entirely satisfactory in use, made with the lightweight structure described in this disclosure.

The same lower frame was employed with the different width net-walls. It may be 6 ft. 10 inches long by 3 ft. 10 inches deep (2.08 × 1.11 meters).

Figure 4:
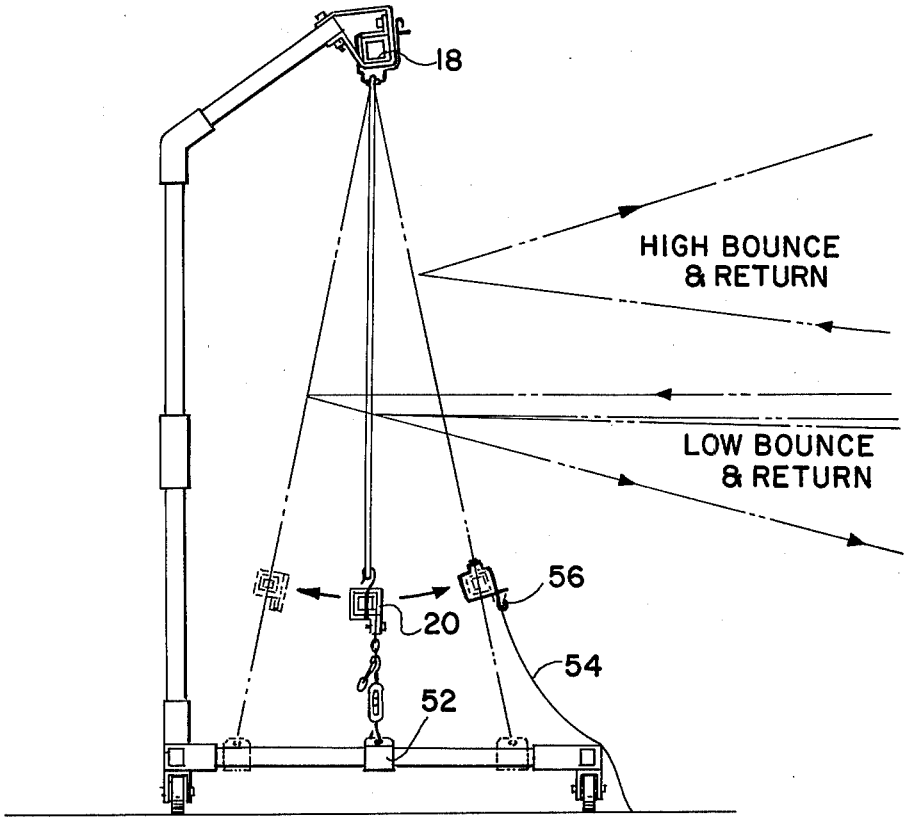
FIG. 4 is a side elevation.

FIG. 4 is a side elevation diagramming adjustment of the vertical angle of the net by means of sliding slip-and-lock closed channels 52 pivotally swinging the lower standard 20 forward relative to the upper standard 18 to produce high bounce and return as indicated, and rearward to produce low bounce and return, as indicated.

Accommodative tension-adjustment is easily made by means of the turnbuckle and chain assembly. Height of the unit and position of the upper standard defining the upper margin of the net wall remain constant regardless of angular adjustment of the net wall.

A vinyl sheet apron 54 secured at the top at grommets 56 to the lower standard across the width of the unit and draped to the ground may be used to represent a playing net.

Figure 5:
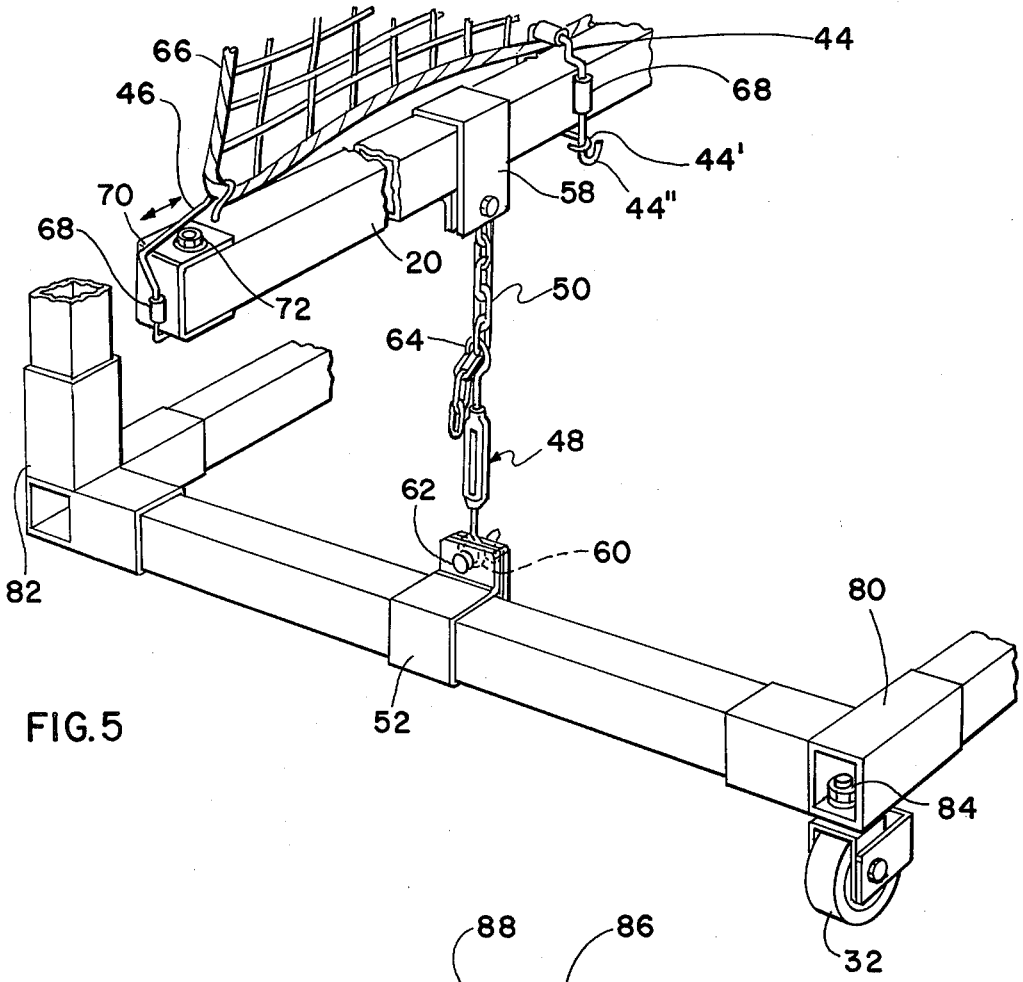
FIG. 5 is a detail taken at 5—5, FIG. 3.

FIG. 5 shows details of the serially related turnbuckle and chain in assembly for adjustable attachment. A clip 58 around the lower standard screw-attaches the upper end of the chain. Wingnut-and-screw clamped slip-and-lock closed channel 52 pivotally engages eye 60 at the lower end of turnbuckle 48 by means of the wingnut-secured screw 62. Hook 64 on the upper end of the turnbuckle provides quick engagement with a selected link of the chain 50 for first or coarse adjustment, followed by any necessary second or fine adjustment using the turnbuckle serially related to it.

Coaction of the hook and chain structure with the slip connection mounting of the davit arms permits the net-wall to be furled, removed with the upper frame and stored or substituted by a difference size at a moment's notice, by unhooking the lower standard at the chain and slipping out the davit arms at either the upper or the lower box connections. One person can do this by laying the unit over rearwardly to slide out the davit arms.

Detail of the resilient spring-retainers 44 appears more clearly in this Figure. These are of 0.090 inch (23mm) stainless spring steel tempered wire, in the shape of square loops sized to fit over the net margin and around the standard, bearing on the standard faces at hose-cushions 68. Closure is by terminal hook 44' slidably holding a downward shank vertically yieldable for good net reactance. A terminal hook 44'' on the shank provides means of hanging the vinyl sheet apron previously described.

This Figure also shows in more detail than previously the mounting of the end-tension retainers of the frame members to each other, and the mounting of the wheels.

The end tension retainers may be of 0.090 inch (23mm) stainless spring steel wire, hooked through the net-wall margin 66 at the corner, passing from the hook to a bend outboard the end of the standard, then returning to bear at hose-cushion 68 on clip 70 closing the end of the standard and secured at a loop terminus beneath bolt 72 on the far side of the standard from the net.

The frame tubing and standards may be square-section fiberglass tubing secured by two-way 80 and three-way 82 slip fit aluminum connectors, and the standards may be of the same square section fiberglass tubing. Tubing wall thickness is preferably 0.125 inch (3.1mm); in section the tubing may measure 2 inches (50.8mm) on a side. Bolts may be used further to secure the tubing and connectors if desired. Overlap of connector with tubing is preferably at least 4 inches (10.16cm).

The wheels 32 may have threaded shanks 84 passed through the connector lower wall and secured with nuts through access provided by open-end connector structure.

FIGS. 6*a* and 6*b* detail the clips 86 detachably attaching the upper standard 18 to the upper ends of the davit arms 40. Square "G" -shaped clips tapering from a small flat bottom to a wide top attach at the free ends of the upper ends of the davit arms by bolts 88.

The upper standard is retained by an angle 90 secured by bolt 92 to the clip. The angle forces the standard into secure position in the narrow bottom of the clip, but makes removal simple, quick and easy.

It is evident that the invention has many advantages which will appear in use. The structure is inherently difficult to damage, and the net will remain in-plane and the rebound constantly predictable as a consequence, although it is also evident that the slip-and-lock closed channels may be placed at relatively different locations so as to impart a warp to the net if such is desired to make the return less predictable. For the same purpose the net wall tension may be varied deliberately by the tension adjustment.

The surprisingly superior action of the net-wall evidently can derive in part from the resilient bow-shaped side elevational aspect of the invention, and from the relative independence of the standards. The method of tensioning of the net also imparts freedoms which may contribute.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. A tennis practice rebounder comprising: a frame, a net wall having upper and lower and end margins and a front, means for suspending the net wall by the upper margin including a first standard on the frame and means for attaching the upper margin thereto, means for adjustably tensioning the net wall between the upper and lower margin including means for pivotally adjusting the lower margin about the upper margin for setting the vertical angle of the net wall; the means for pivotally adjusting including a pair of frame portions below and in fore and aft relation to the lower margin, means for drawing the lower margin toward the frame portions including: a second standard, means for attaching the lower margin to the second standard thereby providing the second standard with net-wall-tensioning connection through the net wall with the first standard; and means for movably attaching the second standard to the respective frame portions, including respective first and second serially related length adjustments proximate each end of the second standard.

2. A tennis practice rebounder comprising: a net wall having upper and lower and end margins and a front, means for suspending the net wall by the upper margin, means for adjustably tensioning the net walls between the upper margin and the lower margin, including means for pivotally adjusting one of said margins about another of said margins for setting the vertical angle of the net wall; the means for pivotally adjusting including a frame portion, means for drawing the lower margin toward the frame portion, means for adjustably positioning a part of the drawing means relative to the frame portion; the frame portion being below the lower margin and oriented generally fore and aft relative thereto; the means for adjustably positioning including a movable attachment to the frame portion, for adjustable positioning fore-and-aft along the frame portion; and the means for drawing including first and second serially related length adjustments, the first length adjustment providing for coarser adjustment than the second length adjustment.

3. A tennis practice rebounder as recited in claim 2, the first length adjustment having chain and hook structure, and the second length adjustment having turnbuckle structure.

4. A tennis practice rebounder as recited in claim 3, the frame portion including first and second laterally spaced frame members, the means for adjustably positioning including first and second of said movable attachments respectively providing adjustable positioning with the first and second frame members.

5. A tennis practice rebounder as recited in claim 4, all said first and second means for adjustably positioning being independently movable relative to each other.

6. A tennis practice rebounder comprising: a net wall having upper and lower and end margins and a front, means for suspending the net wall by the upper margin, means for adjustably tensioning the net wall between the upper margin and the lower margin, including means for pivotally adjusting one of said margins about another of said margins for setting the vertical angle of the net wall; the means for pivotally adjusting including a frame portion, means for drawing the lower margin toward the frame portion, means for adjustably positioning a part of the drawing means relative to the frame portion; the frame portion being below the lower margin and oriented generally fore and aft relative thereto and including first and second laterally spaced frame members, the means for adjustably positioning respectively providing movable attachment with the first and second frame members; the means for suspending including a first standard and means for attaching the upper margin thereto, the means for drawing including a second standard and means for attaching the lower margin thereto; and the second standard having net-wall-tensioning connection with the first standard through the net wall.

7. A tennis practice rebounder as recited in claim 6, the means for suspending including said frame having first and second laterally spaced davit arms, and means connecting all said davit arms with the first standard.

8. A tennis practice rebounder as recited in claim 7, the frame having a base, and the means connecting said davit arms being fixed centrally over the base.

9. A tennis practice rebounder as recited in claim 8, the base being rectangular in outline with said frame portions being respectively at first and second ends thereof and an upright on each of the rearward corners of the frame, each said upright respectively supporting a davit arm.

10. A tennis practice rebounder as recited in claim 9, the support of the davit arms by the uprights including structure providing detachable slip fit therebetween.

11. A tennis rebounder as recited in claim 8, a pair of wheels supporting a first end of the base, and a pair of fixed stands supporting a second end of the frame.

12. A tennis rebounder as recited in claim 8, a skirt depending from the rebounder proximate the lower margin.

13. A tennis rebounder as recited in claim 8, the means connecting the davit arms with the first standard including a respective clip on the end of each davit arm, the first standard passing through each clip, means retaining the first standard therein.

14. A tennis rebounder as recited in claim 8, all said base and uprights comprising tubular structure, and tubular connectors at respective corners thereof for detachably assembling respective said tubular structures.

15. A tennis rebounder comprising a base, plural laterally spaced davit arms, means on the base holding all said davit arms, a standard, means on all said davit arms for holding the standard over the base, a net wall having a front and back and pendant from the standard, adjustable-length means having respective attachment proximate the ends of the net wall for drawing the lower portion of the net wall toward the base, the adjustable length means having net-wall-tensioning connection with the first standard through the net wall, means for attaching slidably in a fore-and-aft direction relative to the net wall the adjustable length means to the base for adjusting the vertical angle of the net wall.

* * * * *